428-408 SR
12/13/83 XR 4,420,529

United States Patent [19]
Westhead

[11] 4,420,529
[45] Dec. 13, 1983

[54] ANTI-STATIC DRYER FABRICS

[75] Inventor: William T. Westhead, Waycross, Ga.

[73] Assignee: Scapa Dryers, Inc., Waycross, Ga.

[21] Appl. No.: 180,444

[22] Filed: Aug. 22, 1980

[51] Int. Cl.[3] ..... B32B 5/16
[52] U.S. Cl. ..... 428/244; 57/901; 139/323 A; 139/425 A; 428/245; 428/257; 428/367; 428/373; 428/389; 428/408; 428/922
[58] Field of Search ..... 428/257, 258, 259, 367, 428/408, 922, 373, 922, 244, 389; 139/383 A, 425 A; 57/901

[56] References Cited

U.S. PATENT DOCUMENTS

| | | | |
|---|---|---|---|
| 2,949,134 | 8/1960 | Hindle et al. | 139/383 A |
| 3,067,779 | 12/1962 | Draper | 139/383 A |
| 3,306,322 | 2/1967 | Willmann | 139/425 A |
| 3,507,019 | 4/1970 | Tate . | |
| 3,582,445 | 6/1971 | Okuhashi . | |
| 3,639,807 | 2/1972 | McCune . | |
| 3,678,675 | 7/1972 | Klein . | |
| 3,778,331 | 12/1973 | Scharf . | |
| 4,015,038 | 3/1977 | Romanski et al. | 428/257 |
| 4,184,519 | 1/1980 | McDonald et al. | 139/425 A |
| 4,232,082 | 11/1980 | Noritake | 428/257 |
| 4,239,065 | 12/1980 | Trokham | 139/425 A |
| 4,259,394 | 3/1981 | Khan | 428/234 |

*Primary Examiner*—James J. Bell
*Attorney, Agent, or Firm*—Fleit, Jacobson, Cohn & Price

[57] ABSTRACT

A dryer felt or fabric with a reduced potential for creating static electricity when running on a papermaking machine. The fabric is woven from a number of machine direction and cross-machine direction yarns with selected machine direction and/or cross-machine direction yarns comprising a blend of anti-static yarn combined with other yarns. The anti-static yarn may take the form of a staple, continuous filament or monofilament and may be a carbon content acrylic anti-static fiber, a silver coated nylon continuous filament, a nylon monofilament coated with carbon, or an acrylic fiber carbon coated. After being woven, the fabric is typically resin treated with a heat-resistant resin.

30 Claims, 11 Drawing Figures

DECAY TIME VS. CONDUCTIVE FIBER SPACING
UNTREATED SAMPLES
TEST CONDITIONS: 20% RH
70% F
SAMPLE 1
SAMPLE 3
SAMPLE 2
SAMPLE 4
CONTROL POINT
NFPA 56A STD 1/2 SEC.
1:128
1:64
1:32
1:16
1:8
CONDUCTIVE FIBER SPACING (ENDS C.F.: ENDS)
18.0
15.0
12.0
9.0
6.0
3.0
0.5
DECAY TIME (SECONDS)

DECAY TIME VS. CONDUCTIVE FIBER SPACING
RESIN-TREATED SAMPLES
TEST CONDITIONS : 20% RH
70% F
SAMPLE 1
SAMPLE 2
SAMPLE 3
SAMPLE 4
CONTROL POINT
NFPA 56A STD 1/2 SEC.
1:8
1:11
1:17
1:24
DECAY TIME (SECONDS)
7.0
6.0
5.0
4.0
3.0
2.0
1.0
0.5
0
1:128
1:64
1:32
1:16
1:8
CONDUCTIVE FIBER SPACING (ENDS C.F.: ENDS)

CONTROL POINT

SURFACE RESISTANCE VS. SPACING
UNTREATED SAMPLES
TEST CONDITIONS: 20% RH
70% F
SURFACE RESISTANCE (OHMS)
$10^{13}$
$10^{12}$
$10^{11}$
$10^{10}$
SAMPLE 1
SAMPLE 3
NFPA STD. 56A
SAMPLE 4
SAMPLE 2
1:128
1:64
1:32
1:16
1:8
CONDUCTIVE FIBER SPACING (ENDS C.F.: END)

SURFACE RESISTANCE VS. SPACING
RESIN TREATED SAMPLES
CONTROL POINT
TEST CONDITIONS: 20% RH
70% F
SAMPLE 1
SAMPLE 3
SAMPLE 4
SAMPLE 2
NFPA STD. 56A
1:22
1:14
$10^{13}$
$10^{12}$
$10^{11}$
$10^{10}$
SURFACE RESISTANCE (OHMS)
1:128
1:64
1:32
1:16
1:8
CONDUCTIVE FIBER SPACING (END C.F.: ENDS)

ANTI-STATIC DRYER FABRICS

BACKGROUND OF THE INVENTION

1. Field of the Invention

The present invention relates to papermakers belts, in general, and to dryer felts incorporating antistatic yarns, in particular.

2. Background of the Prior Art

The problem of static electricity is well-known in the papermaking industry. A spark discharge from highly charged materials is a common occurrence and is thought to have been the cause of numerous unexplained fires. The incidence of static problems in the papermaking industry has tended to increase primarily due to the introduction of new polymers and fiber materials which are decidedly hydrophobic.

Dryer felts, employed in the dryer section of a papermaking machine, are particularly prone to the accumulation of electrostatic charge. In the dryer section, the dryer felt or fabric passes over a number of machine rolls which cause a separation of charge while the rolls and the fabric are in contact. When the dryer fabric leaves a roll, both the roll and the fabric surfaces hold a free electrical charge. The roll, because it is made of metal, has good conductivity thereby losing or markedly reducing the free charge. The fabric, on the other hand, is a poor conductor and retains the free charge. At the next roll, the process is repeated, and, again, the fabric surface holds a free charge in addition to the free charge it previously held. Build up of static under these conditions is therefore fairly rapid.

It is believed that, in general, separation of charge between two insulating materials occurs at their points of contact and is usually increased with rubbing. While the two surfaces are in contact, there is a balance between adjacent layers of charge of opposite polarity. However, when the surfaces are separated, a residual free charge remains on each surface, which causes static problems. In a dryer fabric, the accumulation of electrostatic charge is attributed to frictional rubbing forces encountered by the fabric during contact with the various machine rolls in the dryer section of the papermaking machine.

Such electrostatic accumulations in the dryer fabric can increase the tendency of the fabric to attract and retain foreign matter whereby the fabric tends to clog with dirt. Electrostatic accumulations can also lead to a spark discharge and an attendant fire risk. Sheet separation or sheet follow can also be caused by electrostatic accumulations. In sheet separation, the paper sheet leaves the dryer fabric when it should be travelling with it, whereas, in sheet follow, the paper sheet will not leave the dryer fabric to transfer to another section of the papermaking machine.

The problem of electrostatic accumulation is enhanced in dryer fabrics woven from or including hydrophobic yarns, such as polyesters, nylon, or acrylics, as compared to dryer fabrics made from hydrophilic materials, such as cotton and other natural fibers.

Various attempts have been made to resolve static problems in dryer fabrics. One early attempt is discussed in U.S. Pat. No. 2,949,134 to Hindle et al. In this patent, various yarns with different static charge polarity characteristics are woven into a fabric so that the differing polarities may interact with each other to negate static charge.

Another approach is to increase moisture content in the area where the dryer fabric contacts the machine rolls. However, this approach has a primary shortcoming in that the object of the dryer section is to remove the remaining excess moisture contained in the paper web being dried.

An additional approach, commonly used today, is to apply an anti-static finish to the surface of the yarn. This is generally done during the manufacture of the yarn in the case of synthetic yarns. However, such finishes are generally water soluble and are removed in subsequent paper drying processing, thus, severely limiting the life of the anti-static properties of the dryer fabric.

There is thus a need for a dryer fabric in which the problem of electrostatic charge accumulation is eliminated without any sacrifice in fabric performance characteristics and without a substantial increase in cost. The present invention is directed toward filling that need.

SUMMARY OF THE INVENTION

The present invention relates to a dryer felt or fabric with a reduced potential for creating static electricity when running on a papermaking machine. The fabric is woven from a number of warp or machine direction yarns and a number of weft or cross-machine direction yarns with selected machine direction and/or cross-machine direction yarns comprising a blend of anti-static yarns combined with other yarns. The anti-static yarn may take the form of a staple or continuous filament or monofilament and may be a carbon content acrylic anti-static fiber, a silver-coated nylon continuous filament, a nylon monofilament coated with carbon, or an acrylic fiber carbon coated.

A fabric embodying the subject invention may take many forms. For example, the face of the fabric, which receives the paper web, may contain combinations of machine direction and cross-machine direction knuckles and floats. This is also true of the back or machine roll contacting surface of the fabric.

Certain of the embodiments disclosed contemplate the use of anti-static yarns in the warp or the machine direction. This is so because the warp forms the knuckles or the floats which contact the machine rolls and thereby produce the static charge. Alternatively, if the knuckles or floats are formed by the weft yarns, then the anti-static component should be in the weft and not the warp, as the weft direction knuckles are the ones that contact the rolls. Further, if a dryer fabric has warp knuckles or floats on one face of the fabric and weft knuckles or floats on the other face, then the anti-static component should be in both warp and weft.

Among the considerations for determining the distribution of the anti-static yarns within the dryer fabric are that a sufficient number of anti-static yarns must be present in order to reduce the problem of electrostatic accumulations, that the anti-static yarns be evenly distributed in a balanced relationship throughout the fabric, and that the anti-static yarns be woven into the fabric so that these yarns define a portion of the knuckles or floats appearing on both faces of the fabric.

It is thus a primary object of the subject invention to provide a dryer fabric which does not accumulate electrostatic charge when used in the dryer section of a papermaking machine.

It is another object of the present invention to provide a dryer fabric incorporating anti-static yarns.

It is a further object of the present invention to provide a dryer fabric in which the problem of electrostatic charge accumulation has been eliminated without any sacrifice in the performance characteristics of the fabric.

It is still an object of the present invention to provide a dryer fabric in which the problem of electrosatic charge accumulation has been eliminated without a substantial increase in the cost of fabric production.

These and other objects will become apparent from the following drawings and detailed description.

DETAILED DESCRIPTION OF THE DRAWINGS

Figure 1:
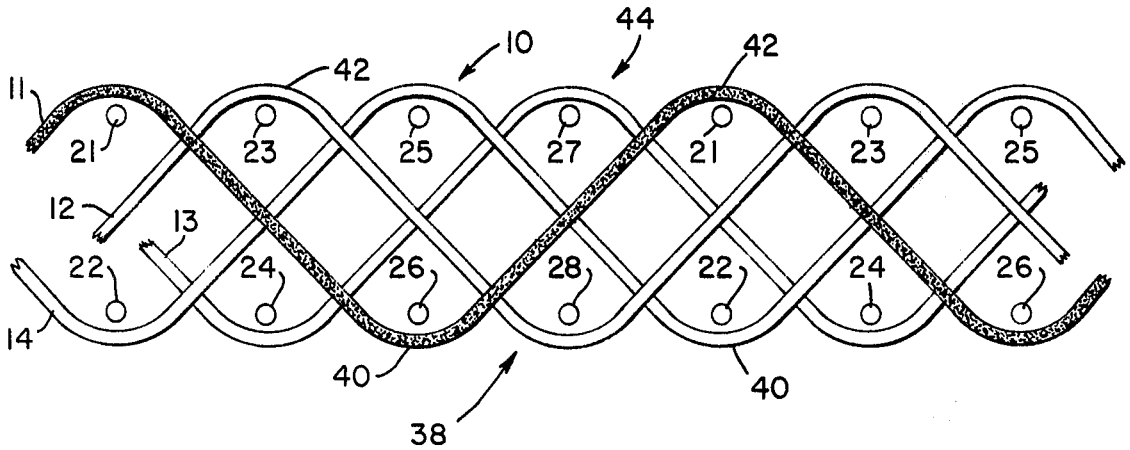
FIG. 1 is a schematic longitudinal section of a portion of a dryer fabric embodying the subject invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Broadly, the present invention relates to a dryer felt or fabric with a reduced potential for creating static electricity when running on a papermaking machine. One embodiment of the fabric, generally designate as 10 in FIG. 1, is woven from a number of warp or machine direction yarns 11–14 and a number of weft or cross-machine direction yarns 21–28 with selected machine direction yarns, for example yarn 11, comprising a blend of anti-static yarn combined with other yarns. The anti-static yarn may take the form of a staple, continuous filament or monofilament and may include, as the anti-static component, a carbon content acrylic anti-static fiber, a silver-coated nylon continuous filament, a nylon monofilament coated with carbon, or an acrylic fiber carbon coated. It is to be understood that these anti-static components are given by way of example and that other known anti-static components are contemplated.

Formed on the fabric back 38 by the machine direction yarns 11–14 are warp or machine direction knuckles 40 which contact machine rolls (not shown) during the paper drying process. In addition, the machine direction yarns also form knuckles 42 on the face 44 of the fabric. As used herein, the term "knuckle" shall be considered to be interchangeable with the term "float", it being the intention to have a knuckle considered as a particular type of float, namely, one which spans one intersecting yarn. For example, a warp knuckle is one which spans one weft yarn in weaving, whereas a weft knuckle is one which spans one warp yarn in weaving. The face normally supports the paper web being dried but also comes into contact with machine rolls.

Figure 3:
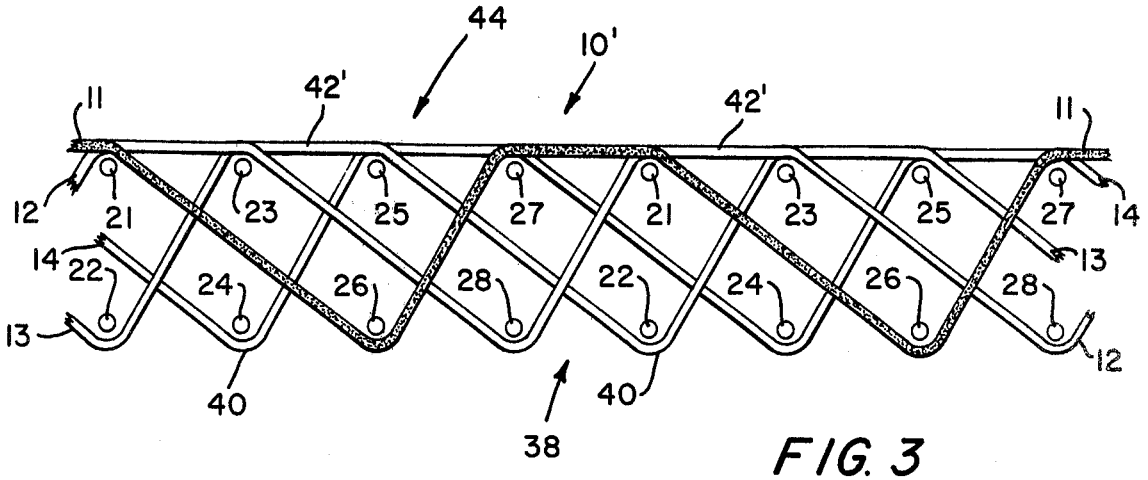
FIG. 3 is a schematic longitudinal section of a portion of another dryer fabric embodying the subject invention.
Figure 4:
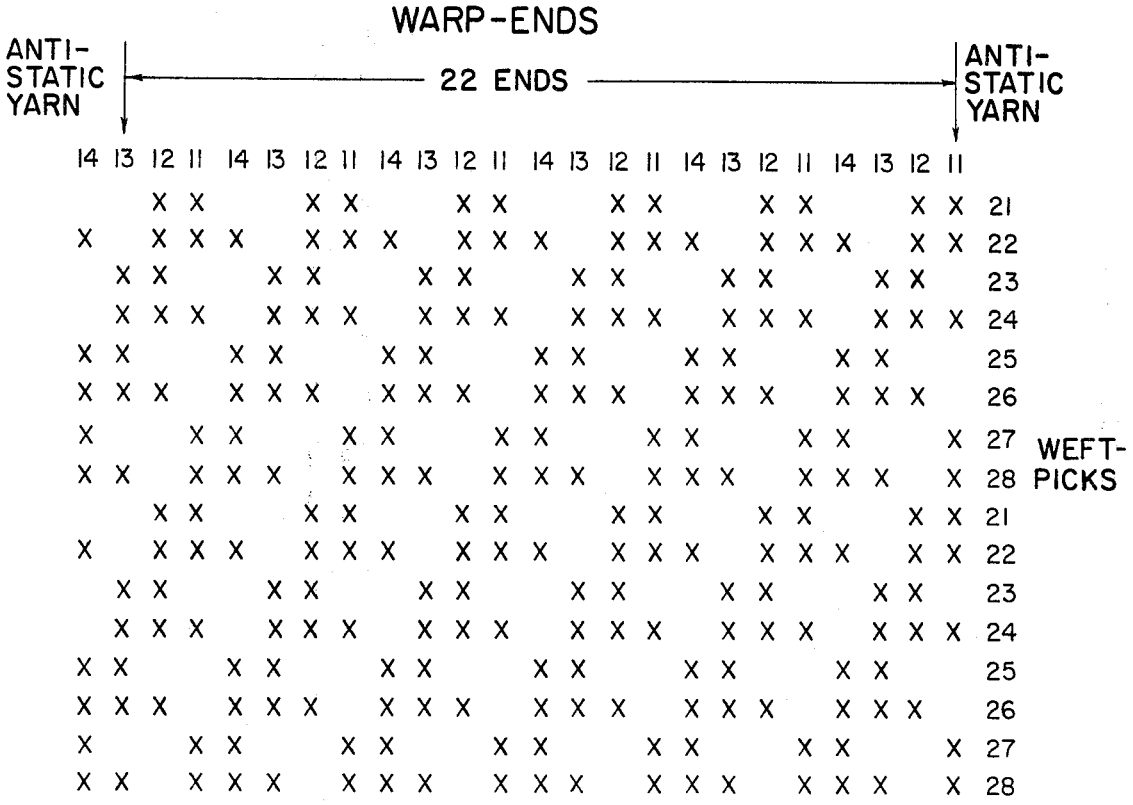
FIG. 4 is an expanded weave pattern for generating the fabric of FIG. 3 and for illustrating an example of anti-static yarn placement.

Another embodiment of the fabric, generally designated as 10' in FIG. 3, is similar to that shown in FIG. 1, except that the machine direction knuckles 42 are replaced by floats 42'. In all other respects, the two fabrics are basically the same; thus, like reference numerals denote like elements.

Recently, a number of synthetic yarns exhibiting anti-static properties have been introduced into the market-place. Such yarns have been produced having carbon or metallic surface coatings, or containing carbon within the synthetic yarn. Spun yarns containing fine metal fibers have also been produced. These yarns are resistant to the conditions which usually remove the anti-static finishes, and, therefore, will be effective throughout the lifetime of the dryer fabric.

One such synthetic yarn exhibiting anti-static properties employs a carbon content acrylic anti-static fiber, which will be called a CCA fiber. The CCA fiber is available in staple and continuous filament form. In staple form, the yarn is in 2.5 d.p.f. (denier per filament) and 1½ and to 3 inch staple length, whereas in continuous filament, the yarn is supplied in 75 denier with 12 filaments (75/12) and 150 denier with 24 filaments (150/24). Normally, the yarn is supplied as a fine spun yarn of 1 end of 20's cotton count (equivalent to 265 denier) containing 10% by weight of the CCA fiber (anti-static component) and 90% by weight of polyester fiber. The yarn as supplied is suitable for twisting with either spun or continuous filament yarn.

Another type of yarn is a silver coated nylon 6.6 continuous filament yarn of 26.5 denier; in this application the yarn will be referred to as an SCN yarn. The yarn is also available, if desired, in 3.8 denier staple fibers. It has been observed that the fine denier of this yarn makes the product readily adaptable for incorporation at twisting, directly into either spun staple or continuous filament warp yarns without affecting the physical properties of the individual warp yarns.

Yet another anti-static yarn is a carbon coated nylon 6 monofilament. The yarn is available in any one of two forms. The first form, which will be called NC-1, is a 21 denier yarn having a monofilament core and a carbon surface. For ease of handling, the yarn is typically offered in the form of one end of NC-1 twisted with 2 ends of continuous filament yarn giving a total of 160 denier for the finished product. The second type of yarn, which will be called NC-2, consists of 11 ends of NC-1 twisted together.

Still another type of anti-static yarn, which will be called AC-1, is an acrylic fiber carbon coated and spun to 20's cotton count. It has been observed that the third type of yarn in staple form can be blended with another fiber prior to spinning, the final yarn still being 20's cotton count.

Figure 2:
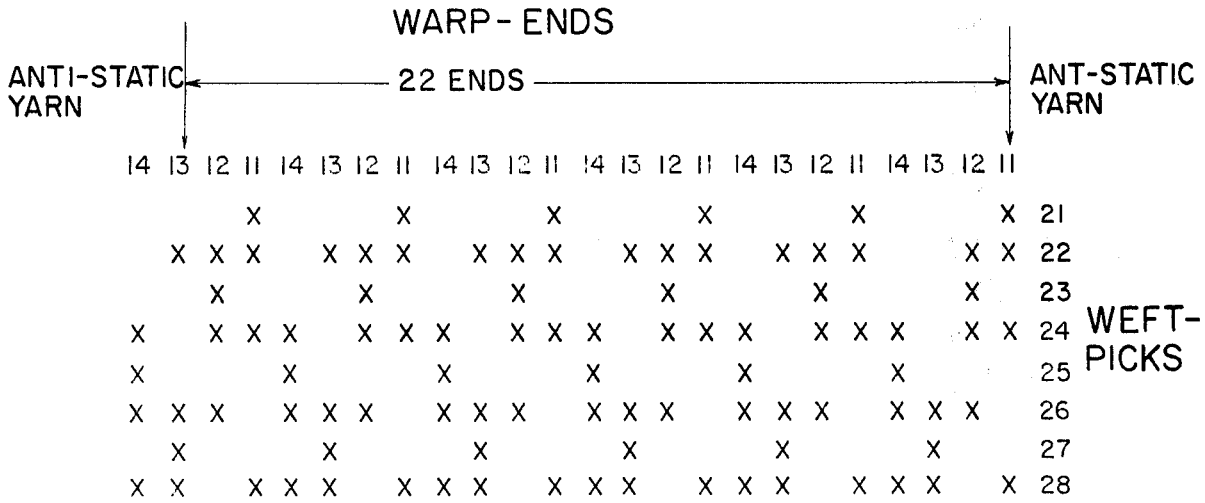
FIG. 2 is an expanded weave pattern for generating the fabric of FIG. 1 and for illustrating an example of anti-static yarn placement.

Based on test results (described in detail hereinafter), a preferred embodiment of a dryer fabric incorporating anti-static yarns is shown in FIGS. 1 and 2. The fabric 10 basically comprises a plurality of machine direction yarns 11–14 and a plurality of cross-machine direction yarns 21–28 interwoven according to the weave pattern of FIG. 2, where the cross-hatches denote warp above weft. A number of warp or machine direction yarns, which in this case is every 22nd warp end, contains an anti-static component comprising a yarn of the NC-2 type, which is 11 ends of nylon 6 monofilament coated with carbon and twisted together. The amount of anti-static component contained in these yarns is approximately 0.525% of the total warp yarn weight. The remaining warp yarns as well as the cross-machine direction yarns are made up of a hydrophobic synthetic material such as polyester. The fabric, after weaving, is treated with a heat-resistant resin of the acrylic, epoxy, or phenolic type in a conventional manner.

It is to be understood that the fabric shown in FIGS. 1 and 2 is given by way of example and that many other weave patterns and fabric designs may incorporate anti-static yarn components in accordance with the teachings of the present invention. Thus, while an inclusion rate of one anti-static yarn every 22 ends is chosen for the fabric of FIG. 1, other fabric types may have the anti-static yarn included more frequently or less frequently. Among the primary considerations for determining the endage at which the anti-static yarn is included are the relative weight of the anti-static yarn compared with the total warp yarn weight and the requirement that the anti-static yarn be evenly dispersed throughout the warp.

With regard to the fabric of FIG. 1, the machine direction and cross-machine direction yarns may be composed of the same or different materials. It has been found that in present dryer felts, the fabric yarns most often contain a major portion of synthetic yarns, the majority of which are made of hydrophobic fibers or filaments.

Because a dryer fabric contacts machine rolls on both the face and back sides of the fabric, the anti-static components should be incorporated into the fabric so that they are present on both the face and back of the fabric. In fabrics which are rubbed multi-directionally, it has been observed that both the warp and weft yarns should contain anti-static fibers or yarns, thereby forming a grid. For unidirectional fabrics, such as dryer felts and fabrics, it has been observed that the anti-static component is most effective in the machine direction. The reasoning for this is that rubbing and frictional contact between the surfaces of the dryer fabric and the machine rolls of the papermaking machine takes place in the machine direction. In addition, electrostatic charge transfer takes place on the machine direction knuckles or floats.

Desirably, the spacing between anti-static machine direction yarns should be on the order of about 1/16 to 2 inches in both the face and back of the dryer fabric with a range of approximately $\frac{1}{8}$ to $\frac{1}{4}$ inch being preferred. The anti-static yarn should be a smooth continuous yarn which is capable of being combined with a wide range of staple or continuous filament yarns as required for different dryer fabric applications. Above all, the anti-static component is preferably one that is readily mixed with many yarn material combinations. The anti-static component, also, is preferably continuous throughout the total length of the fabric.

A dryer fabric made according to the teachings of the subject invention may be resin treated in a conventional manner, which marginally contributes to static reduction. By twisting the anti-static component into the selected machine direction yarns, the component is protected and effective for the life of the fabric.

Based on the information discussed hereinbefore and because of the desirability of any anti-static yarn to be readily available in a form suitable for applying with both continuous filament and spun yarns, the following anti-static yarns were chosen for use in the context of a fabric of the type shown in FIG. 1:

Yarn #1—A carbon content acrylic yarn in the form of a fine spun yarn of 1 end of 20's cotton count (10% CCA anti-static component/90% polyester).

Yarn #2—An SCN yarn in 26.5 denier.

Yarn #3—An NC-1 yarn in 21 denier.

Yarn #4—An NC-2 yarn in 231 denier.

The fabric of FIG. 1 was woven according to the weave pattern of FIG. 2 so that the nonanti-static machine direction and cross-machine direction yarns were of the same basic material, namely, polyester, which is highly hydrophobic. The fabric of FIG. 1 was tested in both a resin treated and nonresin-treated condition. In addition, the fabric of FIG. 1 was woven at 26 picks per inch.

To determine the anti-static performance characteristics of the fabric of FIG. 1, a number of sample fabrics were woven at 12 inch widths. The anti-static machine direction yarns were introduced on a geometric progression based on 8 ends; that is, the anti-static yarn was introduced every 8 ends, every 16 ends, every 32 ends, 64 and 128 ends. Based on a fabric of 60 ends per inch, 1 end in 8 gave approximately $\frac{1}{8}$" spacing, while 1 end in 128 gave approximately 2" spacing. In all of the fabrics tested, the machine direction yarns were 2/1/1,000 polyester yarns and the cross-machine direction yarns were 4/1/1,000 polyester yarns. The designation of 2/1/1,000 polyester means a yarn comprising 2 ends of polyester filament twisted together, each end being of 1,000 denier and being itself twisted prior to plying with the other end. In the fabric of FIG. 1, the two ends were first separately "S" twisted at 12.8 turns per inch. Then the two ends were "Z" plied or twisted together at 8 turns per inch. A select number of different anti-static yarns were produced by introducing one of the anti-static yarns listed in column 2 of Table 1 into a 2/1/1,000 polyester yarn at plying. The designation 4/1/1,000 is the same as 2/1/1,000, except that 4 ends are used instead of 2.

TABLE 1

| Fabric No. | Anti-static Yarn Component |
|---|---|
| Sample 1 | 1 end of 20's/1 10% CCA anti-static fiber. 100 packages, each weighing $\frac{1}{2}$ lb. |
| Sample 2 | 1 end of 26.5 denier SCN nylon yarn 24 packages, each 300 yards. |
| Sample 3 | 1 end of NC-1 (21 denier monofilament) 24 packages, each weighing $\frac{1}{2}$ lb. |
| Sample 4 | 1 end of NC-2 (11 filaments of NC-1) 24 packages, each 300 yards. |

The yield (number of yards per pound of yarn) and the gauge (diameter of yarn in inches) of the anti-static yarn of each fabric sample was measured and compared with a standard 2/1/1,000 denier polyester yielding the results shown in Table 2.

TABLE 2

| | Standard | Sample 1 | Sample 2 | Sample 3 | Sample 4 |
|---|---|---|---|---|---|
| Yield (yds/lb) | 2150 | 1830 | 1974 | 2035 | 1810 |
| Gauge in inch | 0.0210 | 0.0227 | 0.0212 | 0.0209 | 0.0226 |

As stated before, each fabric sample was woven in 12 inch width. In total, 15 samples and a control sample containing no anti-static yarns were woven as follows:

| Every 8th end | Every 16th end | Every 32nd end | Every 64th end | Every 128th end |
|---|---|---|---|---|
| Sample 1 | Sample 1 | Sample 1<br>Sample 2<br>Sample 3<br>Sample 4 | Sample 1<br>Sample 2<br>Sample 3<br>Sample 4 | Sample 1<br>Sample 2<br>Sample 3<br>Sample 4 |

Based on the weave pattern of the fabric of FIG. 1, the introduction of an anti-static yarn every 8th end corresponds approximately to $\frac{1}{8}''$ spacing between the ends. Similarly, every 16th end corresponds to $\frac{1}{4}''$ spacing, every 32nd to $\frac{1}{2}''$ spacing and so forth.

Each of the fabric samples, after being heat set by a conventional method, was then cut in half, yielding a total of 30 anti-static fabric samples of which 15 were resin treated with a heat-resistant resin. In addition, there were two control samples with no anti-static components, one of which was resin treated.

The percentage of anti-static yarn present in the machine direction of each sample was calculated, based on the theoretical yarn deniers. The results are shown in Table 3.

TABLE 3

| | Anti-static Yarn | | | | |
|---|---|---|---|---|---|
| Spacing | Sample 1 | CCA of Sample 1 | Sample 2 | Sample 3 | Sample 4 |
| 1 end in 8 | 1.664% | 0.166% | *0.163% | *0.131% | *1.444% |
| 1 end in 16 | 0.832% | 0.083% | *0.081% | *0.066% | *0.722% |
| 1 end in 32 | 0.416% | 0.042% | 0.041% | 0.033% | 0.361% |
| 1 end in 64 | 0.208% | 0.021% | 0.020% | 0.016% | 0.180% |
| 1 end in 128 | 0.104% | 0.010% | 0.010% | 0.008% | 0.090% |

*Actual samples not produced due to insufficient yarn available.

Each of the samples was tested in accordance with Federal Test Method Standard No. 101 B and American Association of Textile Chemists and Colorists (A.A.T.C.C.) Test Method 76-1972.

The first test method determines the decay time required for an induced charge to dissipate. A standard for anti-static textiles specified by the National Fire Protection Association Standard 56A is Method 4046 of Federal Test Method Standard 101B. This states that after the sample has received its maximum charge from the application of 5,000 volts, the time for the indicated fabric sample potential to drop to 10% of its maximum value shall not exceed 178 second. For all of the fabric samples, the test was carried out in 20% relative humidity at 70° Fahrenheit.

The second test method (A.A.T.C.C. 76-1972), which is also specified by the National Fire Protection Association Standard 56A, measures the surface resistance of the fabric as the electrical resistivity influences the accumulation of electrostatic charge on the fabric. The applied voltage should be 100 volts per inch of inter-electrode spacing. The measured resistivity should be less than $1\times10^{11}$ ohms per unit square of material. This test was also carried out under conditions of 20% relative humidity and 70° F.

The full results of the tests are given in Tables 4 and 5 and are illustrated in the graphs constituting FIGS. 5 through 8.

Table 4 lists the decay time in seconds for all of the fabric samples subjected to Federal Test Method Standard No. 101 B. The first column of the table contains the sample number with the number of anti-static yarn ends per total number of yarn ends in parenthesis.

Under the heading "Decay Time" in Table 4, two columns are listed. The first column deal with the fabric samples produced in accordance with the weave pattern of FIG. 1 but not being resin treated. The second column under the heading "Decay Time" deals with fabric samples which have been resin treated.

TABLE 4

CHARGE-DISCHARGE TEST RESULTS

| Sample No. (Spacing) | Decay Time (seconds) Untreated Fabric | Resin Treated |
|---|---|---|
| Control Sample | 11.7 | 7.0 |
| Sample 1 (1 end in 8) | 0.4 | 0.5 |
| Sample 1 (1 end in 16) | 2.1 | 1.0 |
| Sample 1 (1 end in 32) | 5.9 | 1.9 |
| Sample 2 (1 end in 32) | 6.8 | 1.1 |
| Sample 3 (1 end in 32) | 8.6 | 1.3 |
| Sample 4 (1 end in 32) | 3.9 | 0.8 |
| Sample 1 (1 end in 64) | 11.0 | 2.6 |
| Sample 2 (1 end in 64) | 11.7 | 1.8 |
| Sample 3 (1 end in 64) | 15.4 | 1.8 |
| Sample 4 (1 end in 64) | 14.2 | 1.7 |
| Sample 1 (1 end in 128) | 16.5 | 3.5 |
| Sample 2 (1 end in 128) | 14.8 | 3.4 |
| Sample 3 (1 end in 128) | 15.9 | 3.5 |
| Sample 4 (1 end in 128) | 16.0 | 2.9 |

Table 5 lists the results of subjecting each one of the fabric samples to the A.A.T.C.C. Test Method 76-1972 to determine the surface resistance of the various samples. The first column in Table 5 lists the sample number in a manner similar to that of Table 4. The second column in Table 5 lists the surface resistance associated with each one of the samples which were not resin treated. The third column in Table 5 deals with the surface resistance of each one of the samples which were resin treated.

TABLE 5

ELECTRICAL RESISTIVITY TEST RESULTS

| Sample No. (Spacing) | Surface Resistance (ohms) Untreated Fabric | Resin Treated Fabric |
|---|---|---|
| Control Sample | $4.9\times10^{13}$ | $1.2\times10^{13}$ |
| Sample 1 (1 end in 8) | $5.2\times10^{11}$ | $1.4\times10^{12}$ |
| Sample 1 (1 end in 16) | $5.6\times10^{11}$ | $2.1\times10^{12}$ |
| Sample 1 (1 end in 32) | $5.6\times10^{11}$ | $2.8\times10^{12}$ |
| Sample 2 (1 end in 32) | $1.2\times10^{10}$ | $4.7\times10^{11}$ |
| Sample 3 (1 end in 32) | $4.7\times10^{11}$ | $9.2\times10^{11}$ |
| Sample 4 (1 end in 32) | $1.3\times10^{10}$ | $1.8\times10^{11}$ |
| Sample 1 (1 end in 64) | $7.2\times10^{11}$ | $4.6\times10^{12}$ |
| Sample 2 (1 end in 64) | $1.8\times10^{11}$ | $6.7\times10^{11}$ |
| Sample 3 (1 end in 64) | $5.6\times10^{11}$ | $1.0\times10^{12}$ |
| Sample 4 (1 end in 64) | $8.5\times10^{11}$ | $3.5\times10^{11}$ |
| Sample 1 (1 end in 128) | $1.6\times10^{13}$ | $5.3\times10^{12}$ |
| Sample 2 (1 end in 128) | $7.2\times10^{11}$ | $2.3\times10^{12}$ |
| Sample 3 (1 end in 128) | $1.4\times10^{12}$ | $1.3\times10^{12}$ |

TABLE 5-continued

ELECTRICAL RESISTIVITY TEST RESULTS

| Sample No. (Spacing) | Surface Resistance (ohms) Untreated Fabric | Resin Treated Fabric |
|---|---|---|
| Sample 4 (1 end in 128) | $6.0 \times 10^{11}$ | $5.2 \times 10^{11}$ |

The results shown in Tables 4 and 5 are illustrated graphically in FIGS. 5 through 8. Because all of the anti-static yarns were not available to make samples at every desired yarn spacing, the information illustrated in FIGS. 5 through 8 has been extrapolated to determine which of the fabric samples tested meet the requirements of the two test methods.

Figure 5:
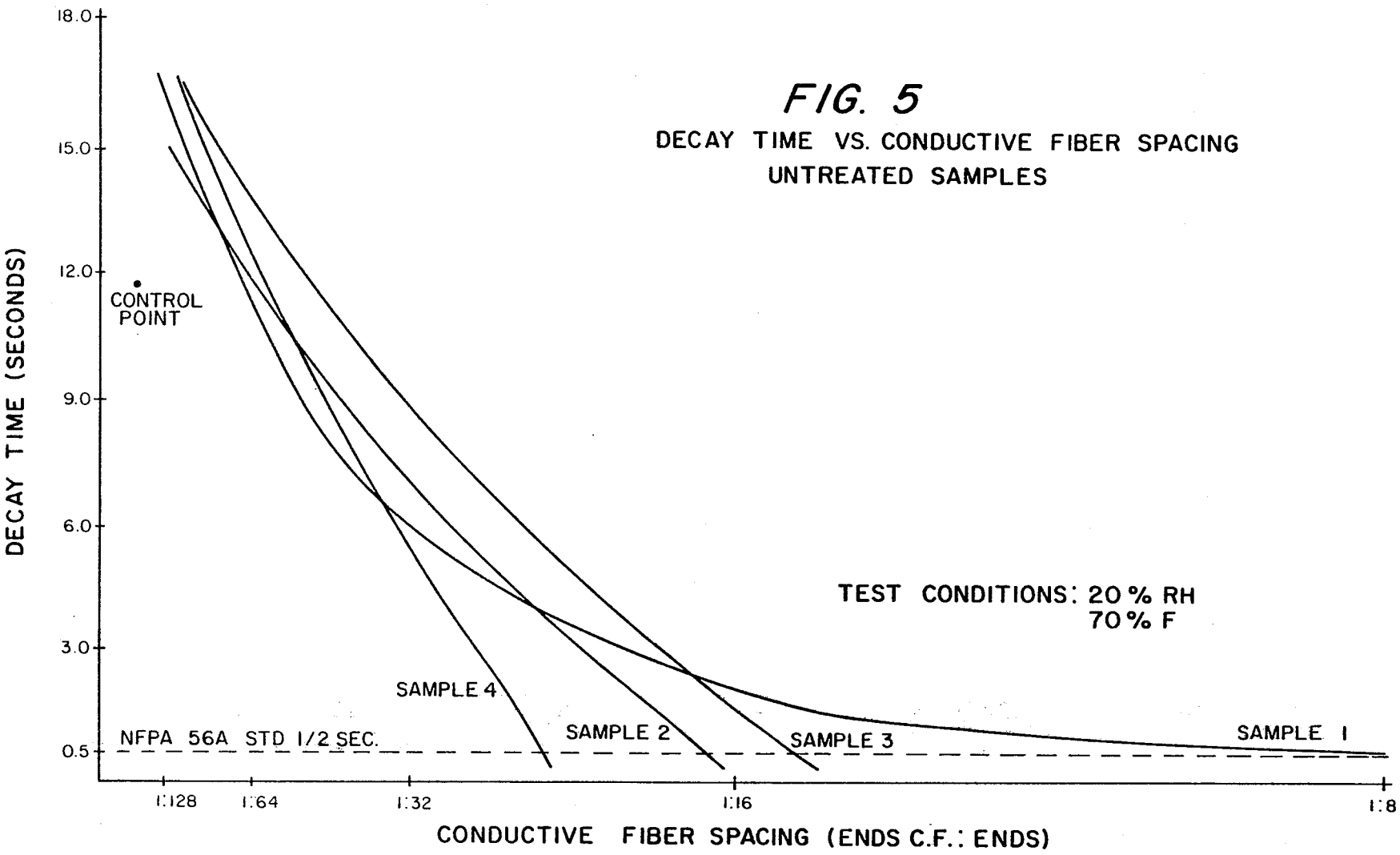
FIG. 5 is a graph of Decay Time v. Conductive Fiber Spacing for different nonresin-treated test samples of the fabric of FIG. 1.

FIG. 5 shows decay time versus conductive fiber spacing for untreated fabric samples. The data for this graph is taken from the appropriate column of Table 4. In FIG. 5, the National Fire Protection Association Standard 56A is shown in dotted lines.

Figure 6:
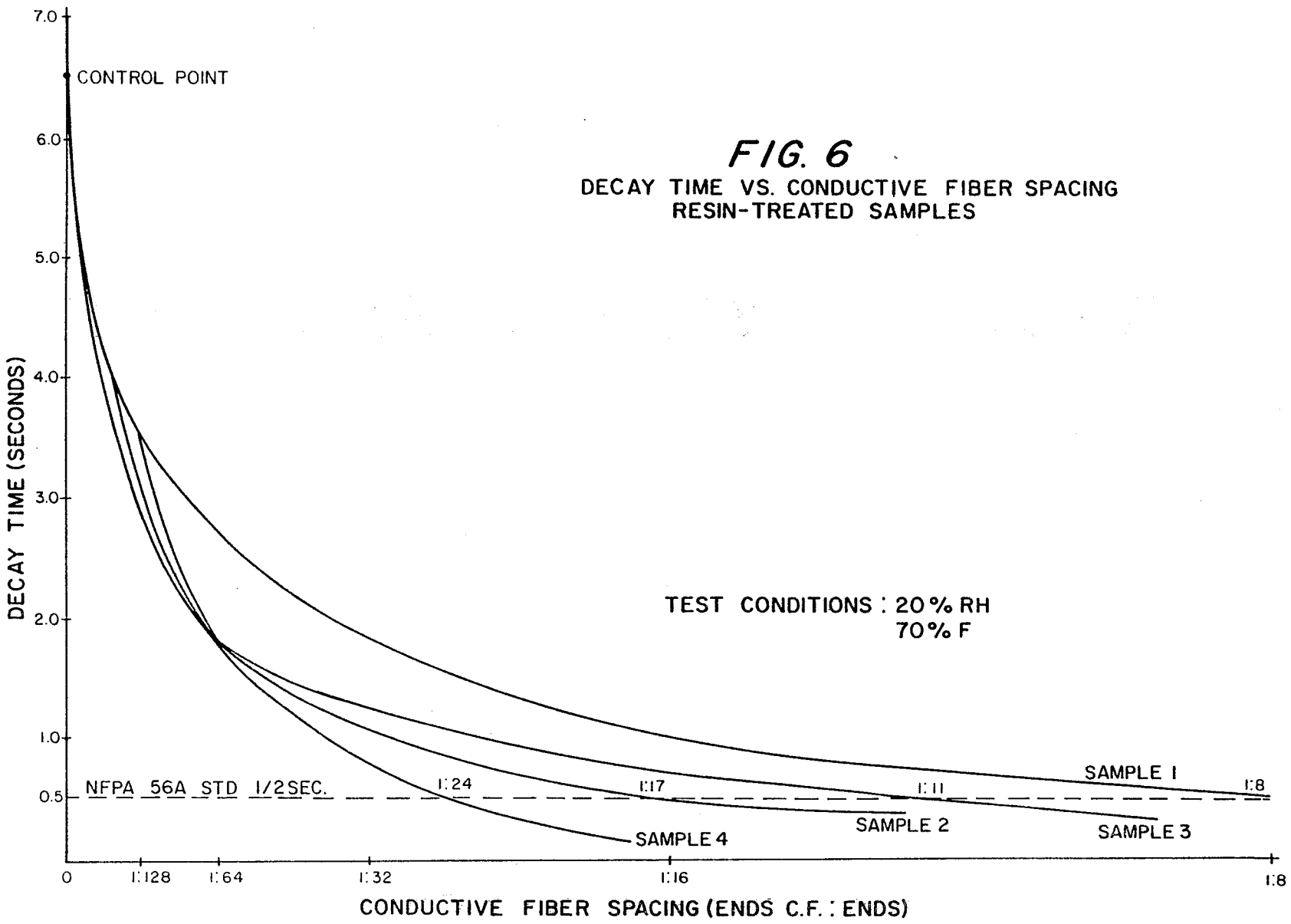
FIG. 6 is a graph of Decay Time v. Conductive Fiber Spacing for different resin-treated test samples of the fabric of FIG. 1.

FIG. 6 shows decay time versus conductive fiber spacing for the resin treated samples. FIG. 6 is of the same format as FIG. 5 and also derives its data from the appropriate column of Table 4.

Figure 7:
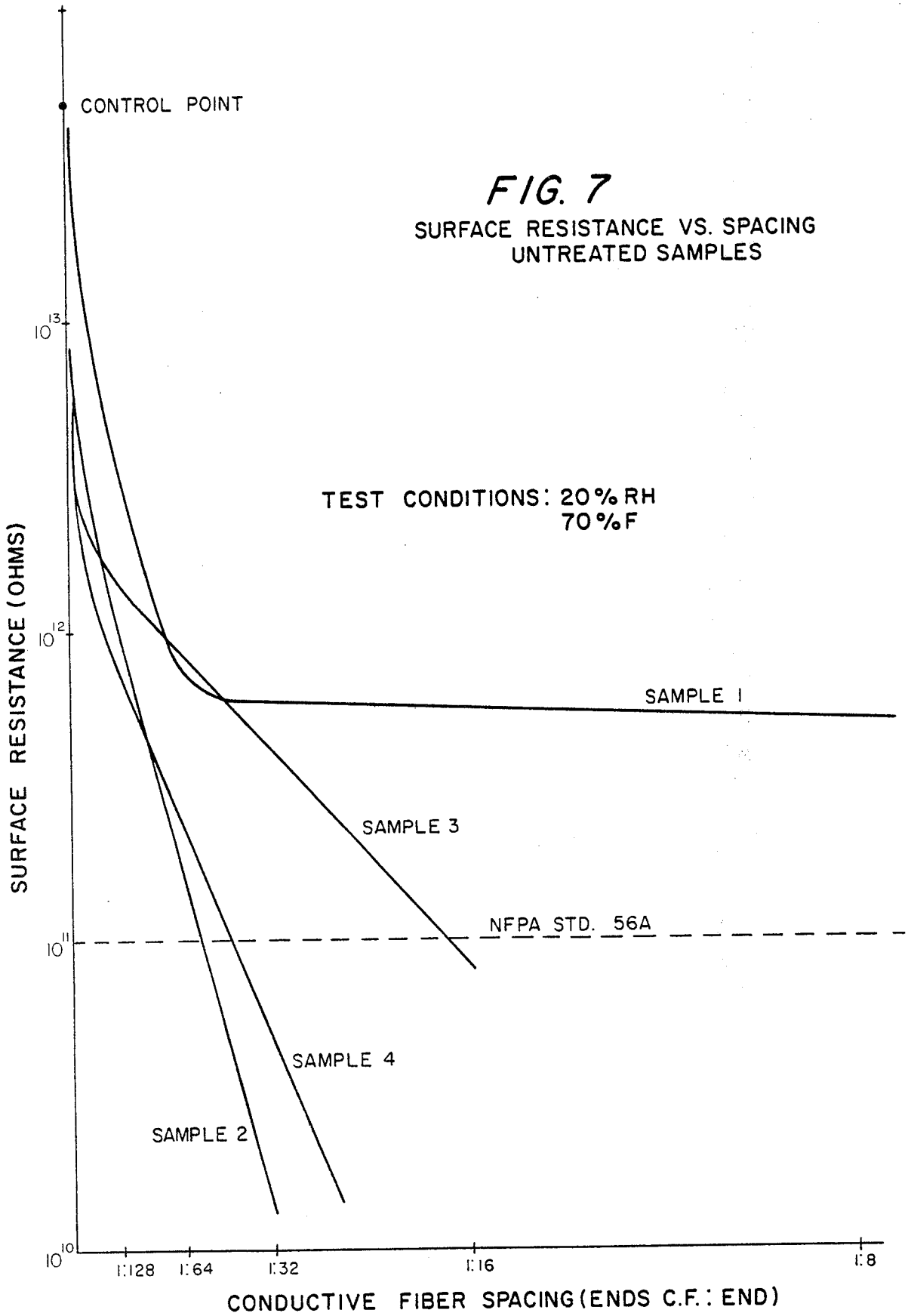
FIG. 7 is a graph of Surface Resistance v. Conductive Fiber Spacing for different nonresin-treated test samples of the fabric of FIG. 1.

FIG. 7 graphically shows surface resistance versus conductive fiber spacing for the untreated fabric samples. The data for this graph was obtained from the appropriate column of Table 5. As in the other figures, the National Fire Protection Association Standard 56A is shown in dotted lines.

Figure 8:
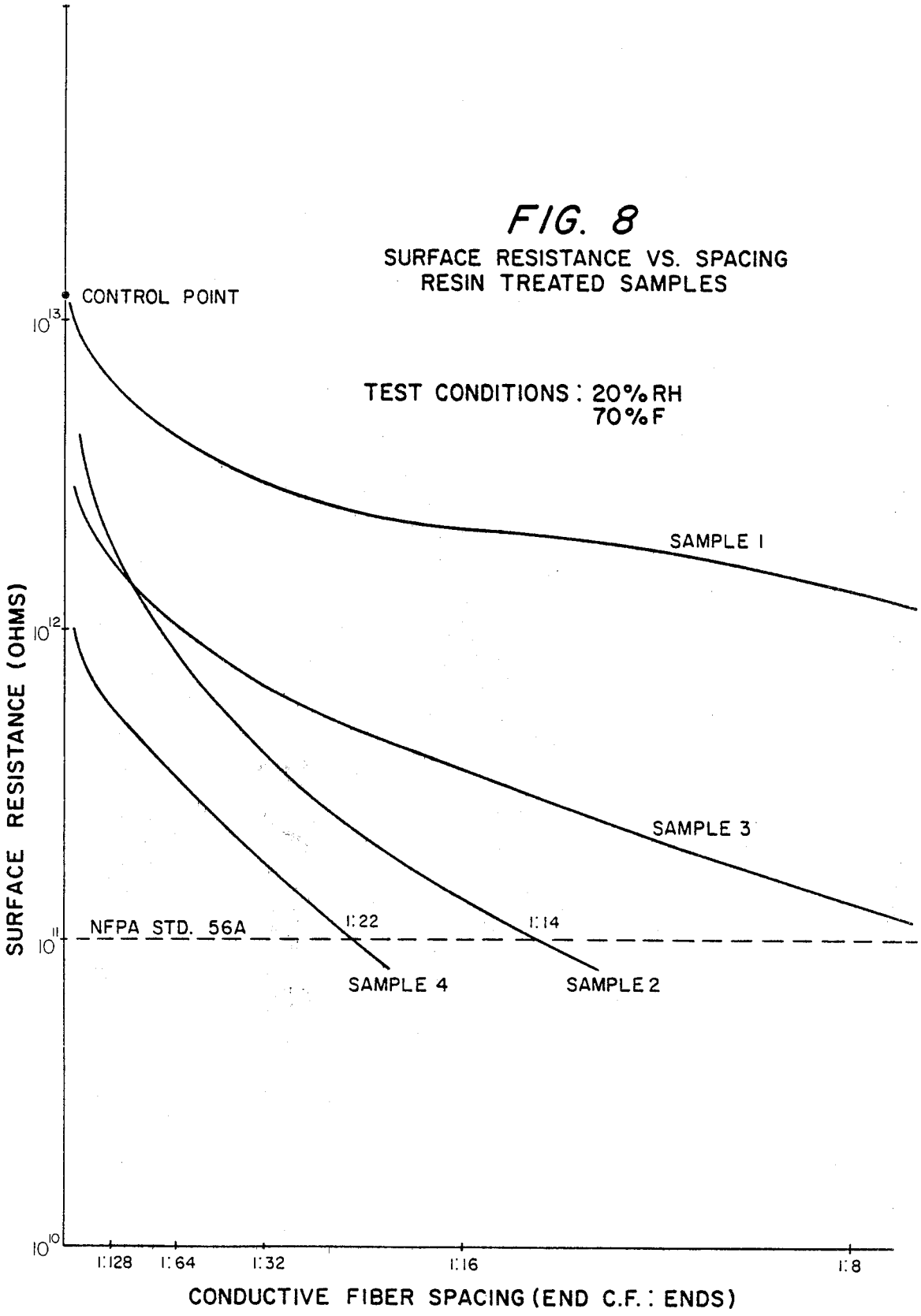
FIG. 8 is a graph of Surface Resistance v. Conductive Fiber Spacing for different resin-treated test samples of the fabric of FIG. 1.

FIG. 8 graphically shows surface resistance versus conductive fiber spacing for resin treated fabric samples and, like FIG. 7, derives its data from the appropriate column of Table 5.

Based on the results set forth in Tables 4 and 5, and illustrated in FIGS. 5 through 8, the spacings required in a resin treated fabric of the type shown in FIG. 1 to meet the two test standards are listed in Table 6.

TABLE 6

| Yarn | Spacing Required to Meet Test A. A. T. C. C. 76-1972 | Test 101 B |
|---|---|---|
| No. 1 (CCA) | Unknown | 1 in 8 |
| No. 2 (SCN) | 1 in 14 | 1 in 17 |
| No. 3 (NC-1) | 1 in 8 | 1 in 11 |
| No. 4 (NC-2) | 1 in 22 | 1 in 24 |

It is apparent from these results that incorporation of anti-static yarns in the fabric is not negated by the application of resin, and, in fact, the application of resin assists in reducing the time to decay of the static charge. Comparison of the control sample with no anti-static component with the samples containing anti-static components verifies this.

As verified by the foregoing tests, the required amount of anti-static yarn component in the machine direction yarns of a resin treated fabric, based on a percentage of a total weight of the machine direction yarns, is shown in Table 7 in terms of a specified amount, a contemplated broad range, and a preferred range.

TABLE 7

| | Specified Amount | Broad Range | Preferred Range |
|---|---|---|---|
| Sample 1 | 1.664% | 1.0–10.0% | 1.6–4.0% |
| Sample 2 | 0.095% | 0.09–0.5% | 0.09–0.3% |
| Sample 3 | 0.131% | 0.1–0.5% | 0.1–0.3% |

TABLE 7-continued

| | Specified Amount | Broad Range | Preferred Range |
|---|---|---|---|
| Sample 4 | 0.525% | 0.1–1.0% | 0.4–0.6% |

With regard to Table 7, from a technical standpoint and considering the permanency of the anti-static component, there is an advantage in considering either sample 1 or sample 4 type yarns. Of these, sample 4 yarns appear more effective. The other two types investigated at 21 and 26.5 denier are obviously more prone to damage affecting their overall effectiveness.

Figure 9:
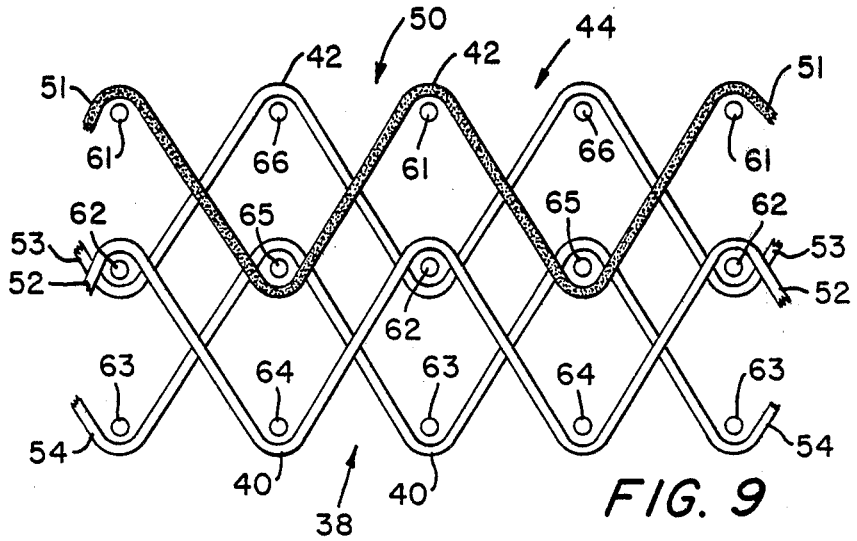
FIG. 9 is a schematic longitudinal section of a portion of yet another dryer fabric embodying the subject invention.
Figure 10:
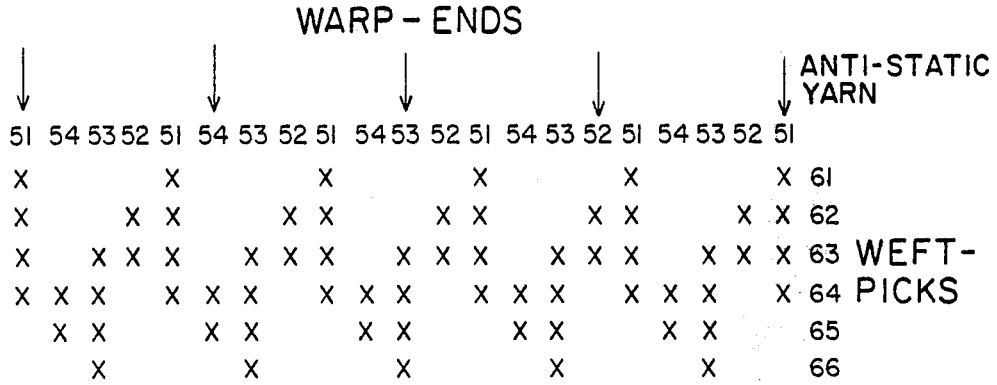
FIG. 10 is an expanded weave pattern for generating the fabric of FIG. 9 and for illustrating an example of anti-static yarn placement.

With reference to FIGS. 9 and 10, yet another embodiment of a dryer fabric embodying the teachings of the subject invention is shown. The multiplane fabric 50 comprises a plurality of machine direction or warp yarns 51–54 and a plurality of cross-machine direction yarns 61–66 interwoven according to the weave pattern of FIG. 10, where the cross-hatches denote warp above weft. Elements similar to those of FIG. 1 bear the same reference numerals.

In the case of the multiplane fabric 50 of the type shown in FIG. 9, the anti-static component must be introduced into both the face 44 and back 38 machine direction yarns, although the actual percentage in the total weight of the machine direction yarns remains unchanged. For example, suppose yarn #4, which is an NC-2 yarn in 231 denier, is chosen as the anti-static yarn. From Table 7 it can be seen that the percentage of anti-static yarn, based on a percentage of total weight of machine direction yarns, is approximately 0.525%. Knowing the weight of an NC-2 yarn as well as the weight of the nonanti-static machine direction yarns, the total optimum number of NC-2 yarns can easily be calculated. Once the optimum number is known, the actual endage spacing can be determined by taking into account that for best performance the anti-static yarns should be evenly distributed about the face and back of the fabric. Thus, for purposes of illustrating the procedure of endage selection only, suppose that the optimum number is 1 anti-static yarn in 5 ends. In order to evenly divide the anti-static yarns between the face 44 and the back 38 of the fabric of FIG. 9, the spacing would be 1 anti-static yarn in 10 ends on the face and 1 anti-static yarn in 10 ends on the back with the anti-static yarns properly staggered to ensure even and balanced distribution in the fabric.

With reference to FIG. 10, the anti-static yarns are denoted by the arrows. Starting from the right hand side of FIG. 10, the endage is as follows:

(a) Yarn 51—anti-static face yarn.
(b) Skip yarns 52, 53, 54 and 51.
(c) Yarn 52—anti-static back yarn.
(d) Skip yarns 53, 54, 51 and 52.
(e) Yarn 53—anti-static face yarn.
(f) Skip yarns 54, 51, 52 and 53.
(g) Yarn 54—anti-static back yarn.
(h) Skip yarns 51, 52, 53 and 54.
(i) Yarn 51—anti-static face yarn (this starts the repeat, being the same as (a) above).

It must also be assumed that, as polyester is one of the most hydrophobic yarns in use, the percentage levels quoted in Table 7 are at least sufficient and probably more than sufficient in other resin treated machine direction and cross-machine direction yarns to meet the requirements of an anti-static resin treated fabric. Finally, increasing the number of anti-static ends will not damage the fabric or its performance. Decreasing the anti-static ends does result in the fabric showing static potential.

It has been observed during the conduction of the tests previously described, that the introduction of the anti-static component has no affect on the physical properties of the finished fabric, with the exception of weight and, even here, the change is very small, amounting to no more than approximately 0.01 to 0.05 ozs. per square foot of finished fabric, depending upon the type of anti-static yarn employed.

Figure 11:
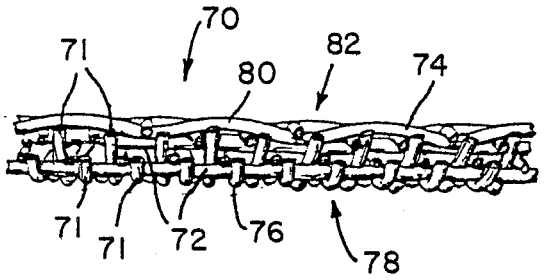
FIG. 11 is a schematic transverse section of a portion of still another dryer fabric embodying the subject invention.

Although the present invention has been shown and described in terms of specific preferred embodiments, it will be appreciated by those skilled in the art that changes or modifications are possible which do not depart from the inventive concepts described and taught herein. For example, the embodiments of the invention illustrated in FIGS. 1, 3 and 9 contemplate the use of the anti-static yarns in the warp or machine direction. This is so because the warp forms the knuckles or floats which contact the rolls and thereby produce the static charge. Alternatively, if the knuckles or floats are formed by the weft yarns, then the anti-static component (in percentages similar to those taught for the warp yarns) should be in the weft and not the warp, as the weft direction knuckles or floats are the ones which contact the rolls. Further, if a dryer fabric has warp knuckles on one face of the fabric and weft knuckles or floats on the other face, then the anti-static component should be in both warp and weft. An example of such a fabric having weft knuckles or floats on the face of the fabric and warp knuckles or floats on the back of the fabric is shown in FIG. 11. The details of this fabric may be found in U.S. Pat. No. 4,182,381 to Gisbourne, incorporated by reference herein. However, as is pertinent to the present discussion, the multiplane fabric 70 of FIG. 11 comprises a plurality of warp yarns 71 interwoven with a plurality of weft yarns 72 and an additional plurality of weft yarns 74 to define warp direction knuckles 76 on the back or machine roll contacting surface 78 of the fabric and weft direction floats 80 on the face or paper-receiving surface 82 of the fabric. The considerations for determining the anti-static yarn endage count are similar to those presented for FIG. 9 with the realization that the weft yarns 74 of fabric 70 replace the warp yarns 51, 53 of fabric 50 in the determination.

Finally, it is contemplated that, through the use of the anti-static components discussed hereinbefore, similar anti-static properties can be imparted to fabrics which are not resin treated nor made from resin treated yarns. Such changes and modifications are deemed to fall within the purview of these inventive concepts.

What is claimed is:

1. A dryer fabric having face and back surfaces, said dryer fabric comprising:

a plurality of machine direction and cross-machine direction yarns interwoven to define machine roll contacting floats on both the face and back surfaces of said fabric, a select number of the yarns that define said floats being anti-static yarns, said select number of yarns chosen so that floats defined by anti-static yarns are present on both the face and back surfaces of said fabric, each of said anti-static yarns comprising a non-conductive synthetic yarn incorporating a component exhibiting anti-static properties.

2. The dryer fabric of claim 1, wherein said anti-static yarns are confined to the machine direction.

3. The dryer fabric of claim 1, wherein said anti-static yarns are confined to the cross-machine direction.

4. The dryer fabric of claim 1, wherein said woven fabric is resin treated with a heat-resistant resin.

5. The dryer fabric of claim 1, wherein said machine direction and cross-machine direction yarns comprise resin treated yarns.

6. The dryer fabric of claim 2, wherein said anti-static yarns represent approximately 0.525% by weight of said machine direction yarns.

7. The dryer fabric of claim 2, wherein said anti-static yarns represent approximately 0.1% to approximately 10.0% by weight of said machine direction yarns.

8. The dryer fabric of claim 2, wherein said anti-static yarns represent approximately 0.1% to approximately 4.0% by weight of said machine direction yarns.

9. The dryer fabric of claim 1, wherein the remaining machine and cross-machine direction yarns comprise hydrophobic yarns.

10. The dryer fabric of claim 9, wherein said hydrophobic yarns are chosen from the group consisting of polyester yarns, polyamide yarns, and acrylic yarns.

11. The dryer fabric of claim 1, wherein said cross-machine direction yarns all comprise hydrophobic yarns.

12. The dryer fabric of claim 11, wherein said hydrophobic yarns are chosen from the group consisting of polyester yarns, polyamide yarns, and acrylic yarns.

13. The dryer fabric of claim 1, wherein said floats are knuckles.

14. The dryer fabric of claim 1, wherein said floats are warp direction floats.

15. The dryer fabric of claim 1, wherein said floats are weft direction floats.

16. The dryer fabric of claim 13, wherein said knuckles are machine direction knuckles.

17. The dryer fabric of claim 13, wherein said knuckles are cross-machine direction knuckles.

18. The dryer fabric of claim 1, wherein said anti-static yarn comprises an acylic yarn with carbon dispersed therein.

19. The dryer fabric of claim 18, wherein said acrylic yarn is in the form of a staple fiber.

20. The dryer fabric of claim 18, wherein said acylic yarn is in the form of a continuous filament.

21. The dryer fabric of claim 1, wherein said anti-static yarn comprises a polyamide core coated with silver.

22. The dryer fabric of claim 21, wherein said nylon core is a continuous filament.

23. The dryer fabric of claim 1, wherein said anti-static yarn comprises a monofilament core and a carbon coating disposed about the surface of said core.

24. The dryer fabric of claim 23, wherein said monofilament core comprises polyamide fiber.

25. The dryer fabric of claim 1, wherein said anti-static yarns are in both the machine and cross-machine directions.

26. The dryer fabric of claim 1, wherein said floats are defined on both said face and back surfaces, said floats on one of said face and back surfaces being machine direction floats and said floats on the other of said face and back surfaces being cross-machine direction floats.

27. The dryer fabric of claim 1, wherein said floats are knuckles.

28. The dryer fabric of claim 1, further comprising additional machine roll contacting floats disposed across the back surface of said fabric, said additional floats being defined by said machine direction and cross-machine direction yarns, a select number of the yarns that define said additional floats being anti-static yarns.

29. The dryer fabric of claim 1 wherein said anti-static component is dispersed throughout the non-conductive synthetic yarn.

30. The dryer fabric of claim 1 wherein said anti-static component is non-metallic.

* * * * *